US007279677B2

(12) United States Patent
Ellis et al.

(10) Patent No.: US 7,279,677 B2
(45) Date of Patent: Oct. 9, 2007

(54) MEASURING WELLBORE DIAMETER WITH AN LWD INSTRUMENT USING COMPTON AND PHOTOELECTRIC EFFECTS

(75) Inventors: Darwin V. Ellis, Ridgefield, CT (US); Charles Fulton, Covington, LA (US); Dhanoolal Kandhai, Lafayette, LA (US)

(73) Assignee: Schlumberger Technology Corporation, Ridgefield, CT ( * ) Notice: Subject to any disclaimer, the term of this patent is extended or adjusted under 35 U.S.C. 154(b) by 220 days.

(21) Appl. No.: 11/208,831

(22) Filed: Aug. 22, 2005

(65) Prior Publication Data

US 2007/0040110 A1 Feb. 22, 2007

(51) Int. Cl.
*G01V 5/12* (2006.01)

(52) U.S. Cl. ..... 250/266; 250/256; 250/264; 250/265; 250/269.3; 250/269.7

(58) Field of Classification Search ..... 250/253, 250/256, 265, 269.3, 266
See application file for complete search history.

(56) References Cited

U.S. PATENT DOCUMENTS

| | | | | |
|---|---|---|---|---|
| 3,321,625 A | | 5/1967 | Wahl | 250/268 |
| 4,432,143 A | * | 2/1984 | Moriarty et al. | 33/544.3 |
| 4,479,564 A | | 10/1984 | Tanguy | 181/105 |
| 4,637,479 A | | 1/1987 | Leising | 175/26 |
| 4,829,176 A | * | 5/1989 | Paske et al. | 250/254 |
| 4,864,129 A | * | 9/1989 | Paske et al. | 250/269.3 |
| 4,879,463 A | | 11/1989 | Wraight et al. | 250/270 |
| 5,017,778 A | | 5/1991 | Wraight | 250/254 |
| 5,130,950 A | | 7/1992 | Orban et al. | 367/34 |
| 5,204,529 A | * | 4/1993 | Diatschenko | 250/268 |
| 5,237,540 A | | 8/1993 | Malone | 367/81 |
| 5,473,158 A | | 12/1995 | Holenka et al. | 250/254 |
| 5,513,528 A | | 5/1996 | Holenka et al. | 73/151 |
| 5,530,243 A | | 6/1996 | Mathis | 250/269.3 |
| 6,552,334 B2 | | 4/2003 | Ellis et al. | 250/269.3 |

OTHER PUBLICATIONS

Chris Labat et al., "3D Azimuthal LWD Caliper", SPE 77526, 2002.
Darwin V. Ellis, "Gamma Ray Scattering Measurements for Density and Lithology Determination", IEEE Transactions on Nuclear Science, vol. 35, No. 1, Feb. 1988, pp. 806-811.

(Continued)

*Primary Examiner*—David Porta
*Assistant Examiner*—Casey Bryant
(74) *Attorney, Agent, or Firm*—John Lee; Vincent Loccisano; Jody Lynn DeStefanis

(57) ABSTRACT

A method for determining the diameter of a wellbore, the wellbore being drilled by a drill string immersed in weighted mud, the weighted mud having a significant weight fraction of a heavy component. A well logging instrument having a gamma ray source and energy-sensitive gamma ray detectors rotates within the wellbore to define a transient interface with a facing portion of the wellbore wall. The instrument measures Compton-effect gamma ray scattering and photoelectric-effect gamma ray scattering of gamma rays that cross a first interface, and of later gamma rays that cross an opposite interface, at each of a plurality of locations along the wellbore to produce a group of gamma ray counts at each of a series of wellbore locations. The counts are used to determine standoffs, weight fraction, and wellbore diameter.

14 Claims, 10 Drawing Sheets

OTHER PUBLICATIONS

Najmud Dowla et al., "Caliper and Borehole Geometry Determinations from Logging while Drilling Measurements and Images", SPWLA 47th Annual Logging Symposium, Jun. 4-7, 2006.

Darwin V. Ellis, "Well Logging for Earth Scientists", Chapter 10 entitled "Gamma Ray Scattering and Absorption Measurements", pp. 201-225.

* cited by examiner

MEASURING WELLBORE DIAMETER WITH AN LWD INSTRUMENT USING COMPTON AND PHOTOELECTRIC EFFECTS

BACKGROUND OF THE INVENTION

1. Field of the Invention

The invention relates generally to the field of instruments used in logging while drilling ("LWD") oil wells in earth formations. More specifically, the invention relates to methods for determining the standoff of a well logging instrument from the wall of a wellbore using measurements made by a gamma-gamma density logging instrument.

2. Description of Related Art

Related art includes methods for determining the standoff of a well logging instrument from the wall of a wellbore by measuring gamma ray scattering, determining apparent formation density values, and compensating for materials interposed between the source and detectors other than the earth formation.

Wellbores are drilled through earth formations for extracting oil, gas, and water, and for other purposes. Wellbores are typically drilled using a rotary drill bit turned by a drilling rig, hydraulically operated motor ("mud motor") or similar devices known in the art. After a wellbore is drilled through earth formation for oil, gas, or water extraction, a protective pipe or casing is typically cemented into the wellbore to maintain the mechanical integrity of the wellbore and to hydraulically isolate the penetrated earth formations from each other. When cementing the casing in place, it is useful to have knowledge of the shape of the wellbore, particularly its diameter along its length, so that the volume of cement needed to fill an annular space between the wellbore wall and the casing can be accurately determined. Various types of caliper devices are known in the art for determining the diameter of the wellbore, such as contact arm devices, and acoustic calipers. A typical contact arm device which can measure the diameter of the wellbore along its length is described in U.S. Pat. No. 3,321,625 issued to Wahl.

It has become common to measure petrophysical properties of the earth formations penetrated by wellbores, called "logging" the wellbore, while the drilling of the wellbore is in progress. See, for example, U.S. Pat. No. 5,513,528 issued to Holenka et al. which describes a method and apparatus for making petrophysical measurements during the drilling process. Such "logging while drilling" (LWD) instruments and methods include those which can make measurements corresponding to the bulk density of the earth formations penetrated by the wellbore. One such instrument is described, for example, in U.S. Pat. No. 5,473,158 issued to Holenka et al. One practical limitation of LWD instruments and methods is that using contact arm-type caliper devices to measure wellbore diameter, such as the one disclosed in the Wahl '625 patent, is extremely difficult and expensive. Consequently, acoustic travel time measurement devices, such as disclosed in the Holenka et al. '528 patent came into use.

More recently, U.S. Pat. No. 6,552,334 issued to Ellis et al. disclosed a method for determining the standoff of a well logging instrument from the wall of a wellbore by measuring gamma ray scattering, determining "apparent formation density" (as measured by X ray absorbance, and as contrasted to physical formation density), and compensating for materials interposed between the source and detectors other than the earth formation. The method of the '334 patent measures standoff based on a response related to "apparent formation density" derived from the counting rate of the longer spaced one of two detectors. The actual response in measuring "apparent formation density" includes an unwanted response component related to density of drilling mud between the source and detectors. The method of the '334 patent compensates for this unwanted response component by using a known value of the "apparent density of drilling mud" (as measured by X ray absorbance) and the difference in counting rate between the longer spaced one and the shorter spaced one of the two detectors.

Two disadvantages of the method of the '334 patent are found to be caused by sensitivity of the method to photoelectric-absorbing material in weighted mud. When mud is weighted with photoelectric-absorbing material like barite (barium sulfate, $BaSO_4$), the "apparent density of the weighted mud" (as measured by X ray absorbance), exceeds its physical density. When the "apparent density of the weighted mud" exceeds its physical density, two disadvantages become evident. A first disadvantage is that if the "apparent density of the weighted mud" (which requires knowledge of the barite weight fraction in the mud) is unknown, the density caliper can be in serious error. A second disadvantage is that if the "apparent density of the weighted mud" approaches "apparent formation density", the density caliper is unusable.

SUMMARY OF THE INVENTION

The invention provides a method for determining LWD standoff and diameter of a wellbore being drilled by a drill string immersed in weighted mud, wherein the weighted mud is weighted with a heavy component of significant weight fraction. The method takes advantage of the different gamma ray attenuation characteristics of Compton-effect and photoelectric-effect gamma ray scattering mechanisms to eliminate errors that might otherwise be caused by incomplete knowledge of local mud density.

A rotating portion of the drill string contains a well logging instrument that includes a gamma ray source and energy-sensitive gamma ray detectors. The logging instrument, as it rotates within the wellbore, defines a transient interface with a facing portion of the wellbore wall.

In a preferred embodiment of a method for determining the diameter of a wellbore in accordance with the invention, the method comprises the steps of a) measuring scattering of gamma rays in a first energy range and in a second energy range that cross a first interface, and of later gamma rays in a first energy range and in a second energy range that cross an opposite interface, at each of a series of axial locations along a wellbore to produce a gamma ray count for each combination of first energy range, second energy range, first interface, opposite interface, short-spaced gamma ray detector, and long-spaced gamma ray detector; b) calculating a first standoff and a second standoff from counts of gamma rays in first energy range and second energy range respectively, at each of the series of axial locations, from gamma ray counts and assumed weight fraction, a different assumed weight fraction having been associated with each one of the series of axial locations; c) selecting, from pairs of first standoff and second standoff along the wellbore having the same assumed weight fraction, the pair having least-squared difference between its standoffs; and d) determining wellbore diameter by setting wellbore diameter equal to a standoff of the selected pair.

In the preferred embodiment, measuring scattering of gamma rays at a given location includes registering counts from gamma rays traveling across a first (bottom) interface, and, after a half-turn of the instrument within the wellbore, registering counts from later gamma rays traveling across an opposite (top) interface.

In the preferred embodiment, gamma ray scattering in a first energy range is Compton-effect gamma ray scattering, gamma ray scattering in a second energy range is photoelectric-effect gamma ray scattering, first standoff is Compton-effect standoff, and second standoff is Pe-effect standoff.

In the preferred embodiment, calculating a Compton-effect standoff for a given location includes using Compton counts to determine formation density at the given location by evaluating a function of assumed weight fraction and formation density.

In the preferred embodiment, calculating a photoelectric-effect standoff includes evaluating a function of assumed weight fraction and Pe counts.

In the preferred embodiment, the function of assumed weight fraction and Pe counts is based on linear-fit approximation to experimentally-derived Pe curves.

In the preferred embodiment, calculating weight fraction includes setting weight fraction equal to the assumed weight fraction of the selected pair.

In a first alternative embodiment of a method for determining the diameter of a wellbore in accordance with the invention, gamma ray scattering in a first energy range is pair-production-effect gamma ray scattering, gamma ray scattering in a second energy range is Compton-effect gamma ray scattering, first standoff is pair-production-effect standoff, and second standoff is Compton-effect standoff.

In a second alternative embodiment of a method for determining the diameter of a wellbore in accordance with the invention, gamma ray scattering in a first energy range is pair-production-effect gamma ray scattering, gamma ray scattering in a second energy range is photoelectric-effect gamma ray scattering, first standoff is pair-production-effect standoff, and second standoff is photoelectric-effect standoff.

In a preferred embodiment of a method for determining the longitudinal shape of a wellbore in accordance with the invention, the method includes a) measuring gamma ray scattering in a first energy range of first gamma rays that cross a first interface, and in a second energy range of second gamma rays that later cross an opposite interface, in both a short-spaced detector and a long-spaced detector, at each of a series of axial locations along a wellbore, to produce a gamma ray count for each combination of first energy range and second energy range, first interface and opposite interface, and short-spaced gamma ray detector and long-spaced gamma ray detector; b) associating an assumed weight fraction with each of the series of axial locations; c) calculating, for each of the series of axial locations, a pair of first and second standoffs from the assumed weight fraction, and counts of gamma rays in first and second energy ranges, respectively; d) selecting the pair having least-squared difference between its standoffs; e) determining wellbore diameter by setting wellbore diameter equal to a function of the calculated values of the selected pair; and f) repeating steps a) to e) at each of a plurality of series of axial locations along the wellbore to determine wellbore diameter at axial regions corresponding to each of the plurality of series of axial locations.

In a preferred embodiment of a method for determining the circumferential shape of a wellbore in accordance with the invention, the method includes a) determining weight fraction of the weighted mud in the region of a series of axial locations along a wellbore; b) measuring gamma ray scattering in a first energy range of first gamma rays that cross a first interface, and in a second energy range of second gamma rays that later cross an opposite interface, in both a short-spaced detector and a long-spaced detector, in the region of the series of axial locations along a wellbore, to produce a gamma ray count for each combination of first energy range and second energy range, first interface and opposite interface, and short-spaced gamma ray detector and long-spaced gamma ray detector; c) calculating standoff from the weight fraction and counts of gamma rays; d) repeating steps b) to c) at a series of azimuthal locations around the wellbore to produce a series of to standoffs at the series of azimuthal locations; and e) determining the circumferential shape of the wellbore by setting wellbore diameter at each azimuthal locations equal to its corresponding standoff;

DETAILED DESCRIPTION

Detailed Description, General

The invention provides a method capable of determining LWD standoff and wellbore diameter accurately in the presence of weighted mud.

The invention uses the same apparatus as disclosed in U.S. Pat. No. 6,552,334 issued to Ellis et al., which is hereby incorporated herein by reference in its entirety. The method of the invention uses the difference between gamma ray attenuation characteristics of Compton-effect and photoelectric-effect mechanisms in the presence of weighted mud. This difference between the gamma ray attenuation characteristics is used to determine local mud density. Determination of local mud density is used to eliminate errors inherent in the method disclosed in the '334 patent when knowledge of local mud density in incomplete.

A first aspect of the invention is determining LWD standoff and wellbore diameter accurately in the presence of weighted mud. A second aspect of the invention is a method for determining the shape of a wellbore by determining a series of wellbore diameters along the length of the wellbore.

Detailed Description, Apparatus

The apparatus used by a preferred embodiment of the method of the present invention is fully described in the '334 patent and is illustrated herein by FIGS. 1-4.

Figure 1:
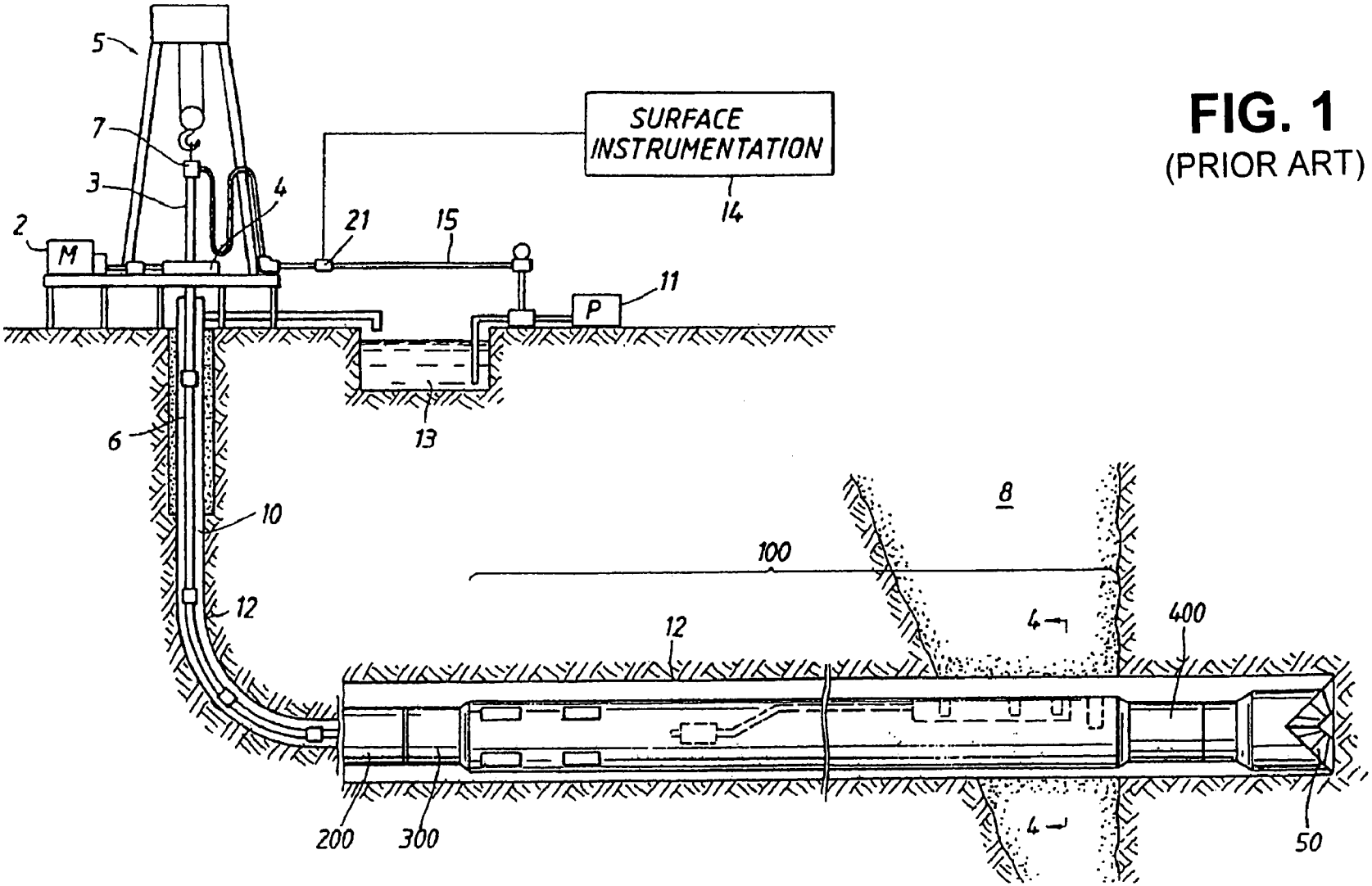
FIG. 1 (PRIOR ART)
FIG. 1 (prior art) shows a drilling rig, a drill string, and prior art LWD apparatus with which the method of the present invention may be used.
Figures 2, 3A:
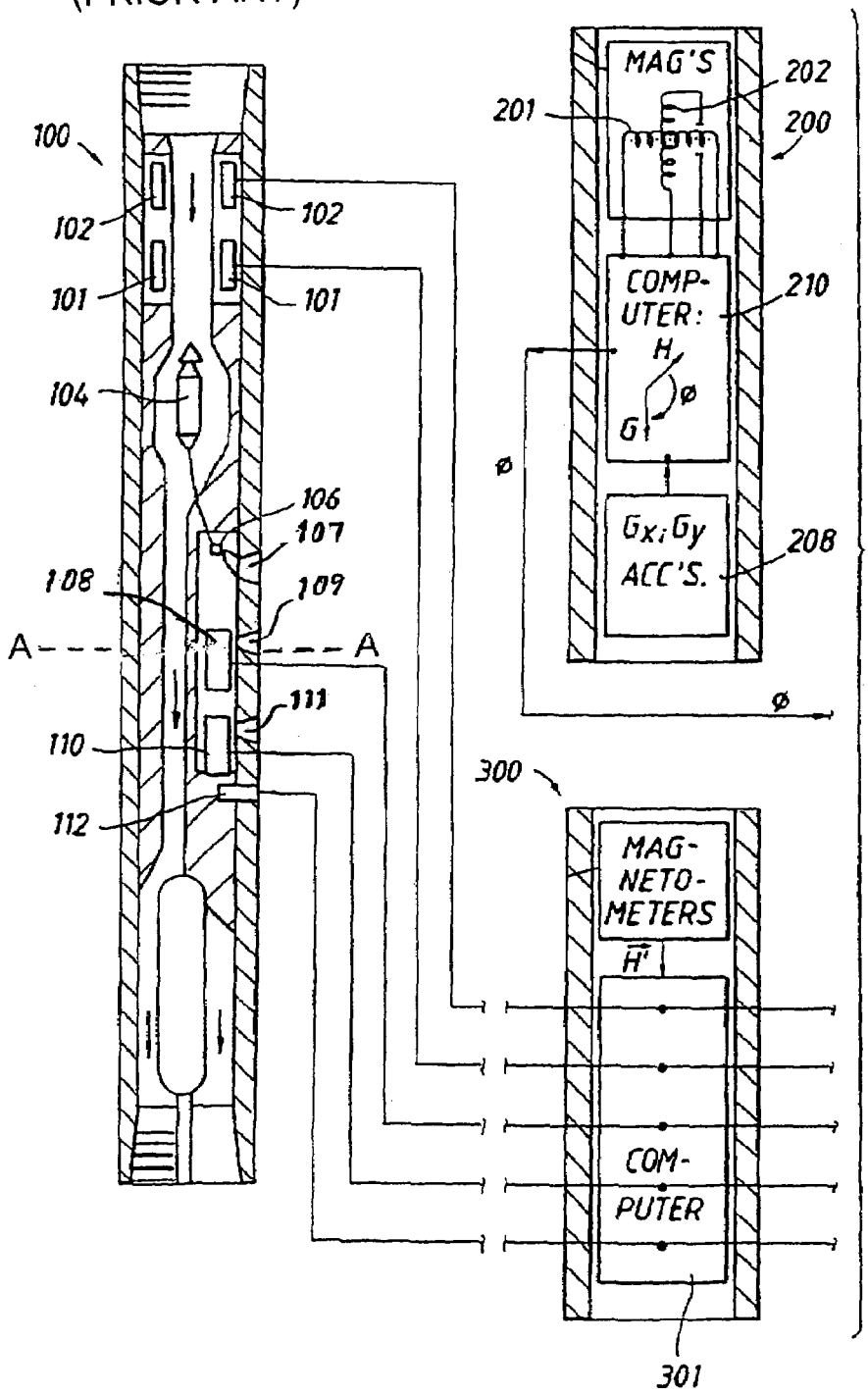
FIG. 2 (PRIOR ART)
FIG. 3A (PRIOR ART)
FIG. 2 (prior art) shows a cross section of the LWD apparatus shown in FIG. 1.
FIG. 3A (prior art) shows accelerometers and magnetometers included in the LWD apparatus shown in FIG. 2.
Figure 3B:
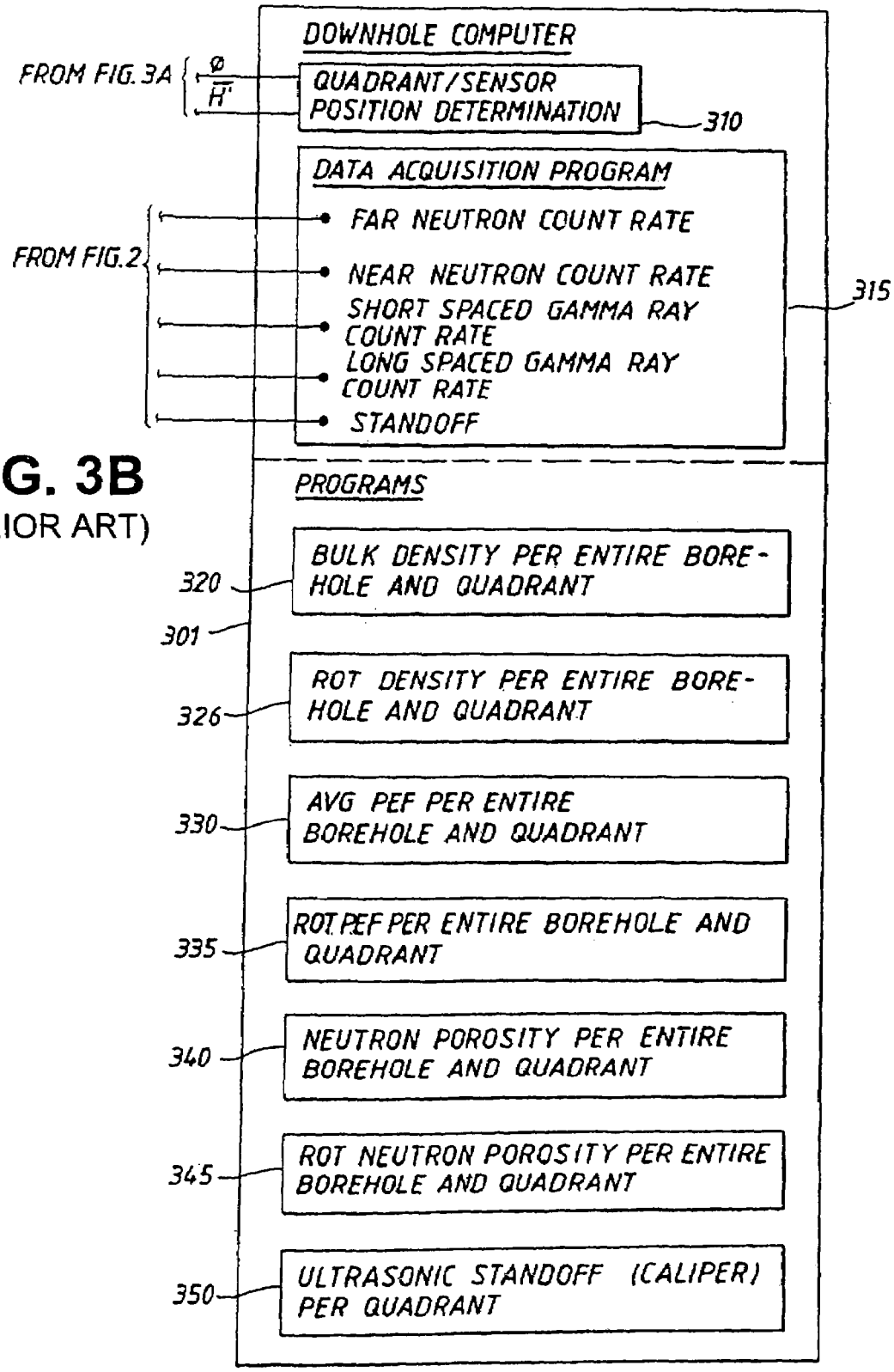
FIG. 3B (PRIOR ART)
FIG. 3B (prior art) shows the LWD apparatus of FIG. 1 including a downhole computer and lists prior art programs that may run on such a computer.
Figure 4:
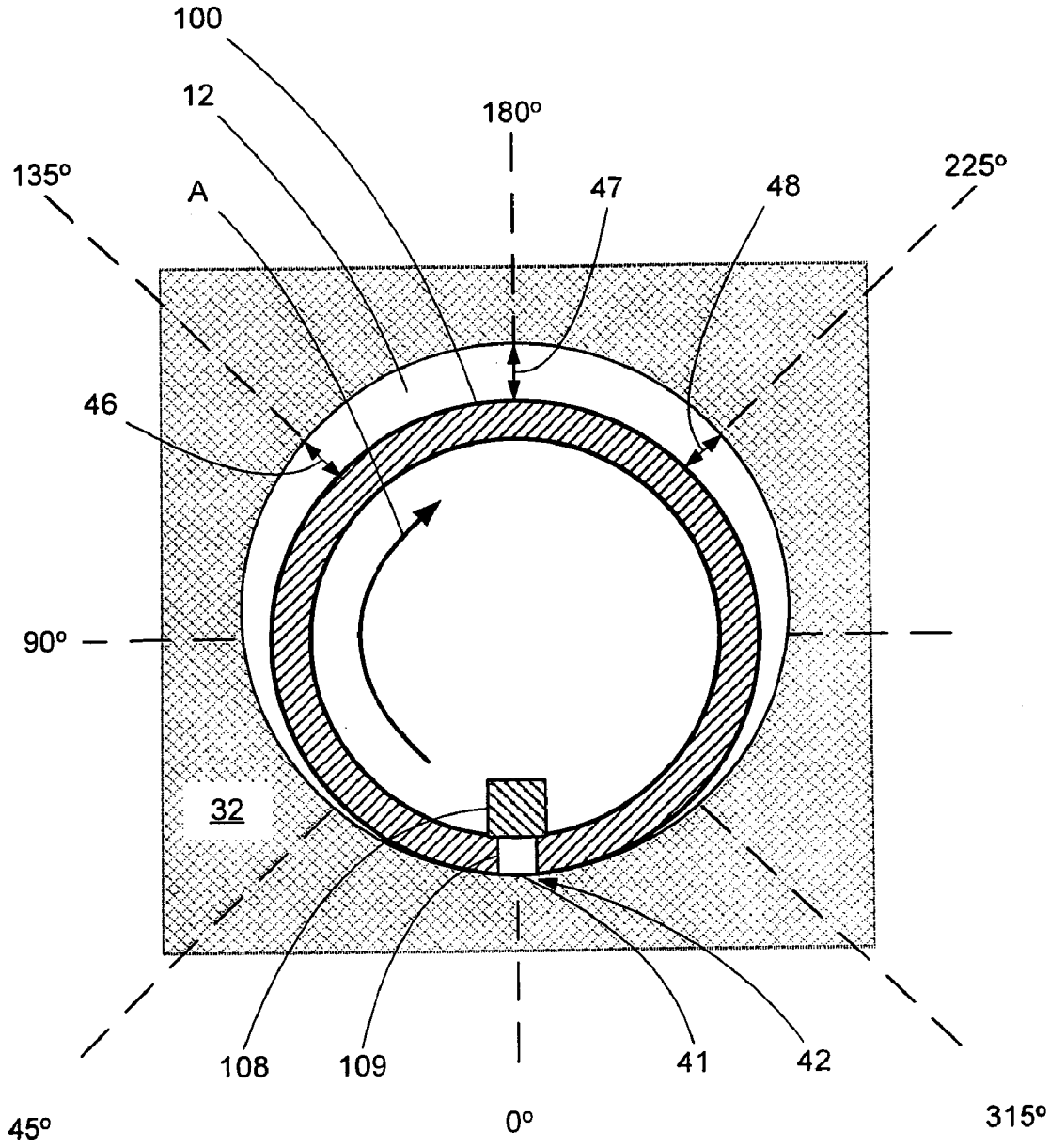
FIG. 4 (PRIOR ART)
FIG. 4 (prior art) shows a cross section through a portion of the LWD apparatus of FIG. 1, at the short-spaced gamma ray detector and window, to illustrate the bottom interface and standoffs.

FIG. 1 (prior art) shows a drilling rig, drill string and an example of an MWD/LWD instrument that may be used with the invention. FIG. 2 (prior art) shows a cross section of the LWD instrument portion of the assembly shown in FIG. 1. FIG. 3A (prior art) shows accelerometers and magnetometers that may be included in various embodiments of LWD instrument such as shown in FIG. 2. FIG. 3B (prior art) shows an example of a downhole computer in an instrument such as shown in FIG. 1, and various types of programs that may run on such a computer. FIG. 4 (prior art) shows a cross section through a portion of the instrument shown in FIG. 1, proximate to the gamma ray source and detectors.

The instrument disclosed in the '334 patent describes irradiating earth formation adjacent the instrument with gamma rays that undergo scattering in an earth formation. The scattered gamma rays are detected at at least two detectors having different spacings along the instrument from the gamma ray source. Gamma ray counting rates at the two detectors are converted through an empirically-derived-transform into values of formation density and a correction factor for the formation adjacent the instrument. The correction factor is intended to provide adjustment for any materials interposed between the source and detectors other than the earth formation. These materials may include: (1) filter cake which settles out of the drilling mud and (2) drilling mud in the event the wellbore is not perfectly round and smooth. Typically, most of the instrument response related to the density of the formation, as opposed to the filter cake and drilling mud, is derived from the counting rate of the longer spaced one of the at least two detectors.

The instrument disclosed in the '334 patent provides measurement of formation density primarily dependent on the counting rates from the detector having the longer, or longest, axial spacing. The axial spacing of a detector refers to the separation, essentially in a direction aligned with the axis of the wellbore, between the detector and the gamma ray source.

The description of the instrument discussed below and shown in FIGS. 1-4, based on the instrument disclosed in the '334 patent, is not meant to limit the scope of the invention.

FIG. 1 (prior art) illustrates a logging while drilling (LWD) instrument 100 connected in tandem with a drilling assembly including drill bit 50. An associated downhole electronics module 300 and MWD instrument 200 including magnetometers and accelerometers are also connected in tandem with LWD instrument 100. The electronics module 300 may be a separate "sub" or it may be disposed within the body of LWD instrument 100. A communication sub 400 is also provided, as illustrated, within the drilling assembly.

LWD instrument 100 is shown for illustration purposes as being in an inclined portion of a borehole at the end of a drill string 6 which turns in a borehole 12 which is formed in earth formation 8 by penetration of drill bit 50. Drilling rig 5 turns drill string 6, or bit 50 may be turned by a hydraulically powered "mud motor" (not shown in the FIGS.). Drilling rig 5 includes a motor 2 which turns a kelly 3 by means of a rotary table 4 or, alternatively, a topdrive or similar rotary powering system known in the art. Drill string 6 includes sections of drill pipe connected end-to-end to the kelly/topdrive 3 and turned thereby. MWD instrument 200, electronics module 300, LWD instrument 100, and communication sub 400 are all connected in tandem with the drill string 6. Such subs and instruments form a bottom hole assembly (BHA) between drill string 6 which includes the drill pipe, and drill bit 50.

As drill string 6 and the BHA turn, drill bit 50 forms borehole 12 by cutting through earth formations 8. Drilling fluid or "mud" is forced by pump 11 from mud pit 13, via stand pipe 15 and revolving injector head 7 through the hollow center of kelly/topdrive 3 and drill string 6, and thence through the BHA to bit 50. The mud acts to lubricate drill bit 50 and to carry borehole cuttings upwardly to the surface via an annular space 10 between the drill string and the wall of wellbore 12. The mud is returned to mud pit 13 where it is separated from borehole cuttings and the like, degassed, and returned for application again to drill string 6.

Communication sub 400 receives signals from various sensors in LWD instrument 100 and from computers in the downhole electronics module 300 and MWD instrument 200. Communications sub 400 is designed to transmit coded acoustic signals representative of signals to the surface through the mud path in drill string 6 and the BHA. The coded acoustic signals are detected by transducer 21 in standpipe 15, where such acoustic signals are detected in surface instrumentation 14. Communication sub 400, including the surface instrumentation necessary to communicate with it, may be arranged as the downhole and surface apparatus disclosed in U.S. Pat. No. 4,479,564 and U.S. Pat. No. 4,637,479, for example. The communication sub 400 may advantageously include the communication apparatus such as disclosed in U.S. Pat. No. 5,237,540.

FIG. 2 illustrates in a schematic way LWD instrument 100. The physical structure of the LWD instrument body and associated sensors is substantially like that described in U.S. Pat. No. 6,552,334 issued to Ellis et al., U.S. Pat. No. 4,879,463 issued to Wraight, et al., and U.S. Pat. No. 5,017,778 issued to Wraight. All three of these patents are assigned to the present assignee. Such patents are mentioned for the description herein of a logging while drilling tool, specifically a compensated density/neutron tool used in logging while drilling measurements of formation characteristics.

LWD instrument 100 includes a neutron source 104 disposed axially, and near and far spaced neutron detectors 101, 102. LWD instrument 100 also includes a gamma ray source 106 located behind source window 107, a short-spaced gamma ray detector 108 located behind short-spaced detector window 109, and a long-spaced gamma ray detector 110 located behind long-spaced detector window 111. LWD instrument 100 may also include an ultrasonic transducer 112 for measuring instrument standoff from the wall of wellbore 12. Such ultrasonic transducer and a system therefor is described in U.S. Pat. No. 5,130,950 issued to Orban, et al., also assigned to the present assignee.

MWD instrument 200 is provided in the bottom hole drilling assembly as schematically indicated in FIG. 1. FIG. 3A schematically illustrates that MWD instrument 200 includes magnetometers 201, 202 oriented along x and y axes (axes perpendicular to the longitudinal axis) of the instrument 200. The x and y axes, therefore, are in the plane of a radial cross section of the instrument 200. The z axis of the tool is oriented along its longitudinal axis. In a similar way, accelerometers $G_x$ and $G_y$ of an accelerometer package 208 (which also includes an accelerometer along the z axis of the tool) are oriented along the x and y axes of the tool. A microcomputer 210 responds to axial components of the earth's magnetic field as measured by the axial magnetometers $H_y$ and $H_x$ and to axial components of the earth's gravity measured by accelerometers $G_x$ and $G_y$ to periodically determine an angle, .ϕ, subtended between magnetic field vector H and gravity vector $G_x$ in the cross sectional plane of MW)D instrument 200. The H vector represents that portion of a vector pointed to earth's magnetic north pole which is projected onto the x-y plane of the MWD instrument 200. The G vector represents the component in the cross sectional plane of MWD instrument 200, of the earth's gravity vector. As illustrated in FIGS. 3A and 3B, a signal representative of such angle ϕ is periodically communicated to downhole computer 301 in the electronics module 300.

The electronics module 300 receives data from near and far spaced neutron detectors 101 and 102, short and long spaced gamma ray detectors 108, 110 and ultrasonic transducer 112. Ultrasonic transducer 112 in this embodiment is angularly aligned with gamma ray detectors 108, 110 and with gamma ray source 106.

As illustrated in FIG. 3B, the downhole computer 301 may include a Quadrant/Sensor Position Determination program 310, a data acquisition program 315, a bulk density calculation program 320, a rotational density per entire borehole and per quadrant program 326, an average photoelectric effect (PEF) program 330, a rotational PEF program 335, a neutron porosity program 340, a rotational neutron porosity program 345, and an ultrasonic standoffs program (Compton & Pe) 350, and others. A program which calculates standoff according to the method of the present invention may also be included on the downhole computer 301.

As illustrated in FIG. 4 (prior art), LWD instrument 100 may be oriented so that the source and detectors are substantially at the bottom 41, or lower or downward side in a wellbore having inclination other than horizontal, of wellbore 12. In such orientation, LWD instrument 100 is most likely to make a measurement that most closely corresponds to the density of the formation surrounding the wellbore 12.

Detailed Description, Method

Figure 5:
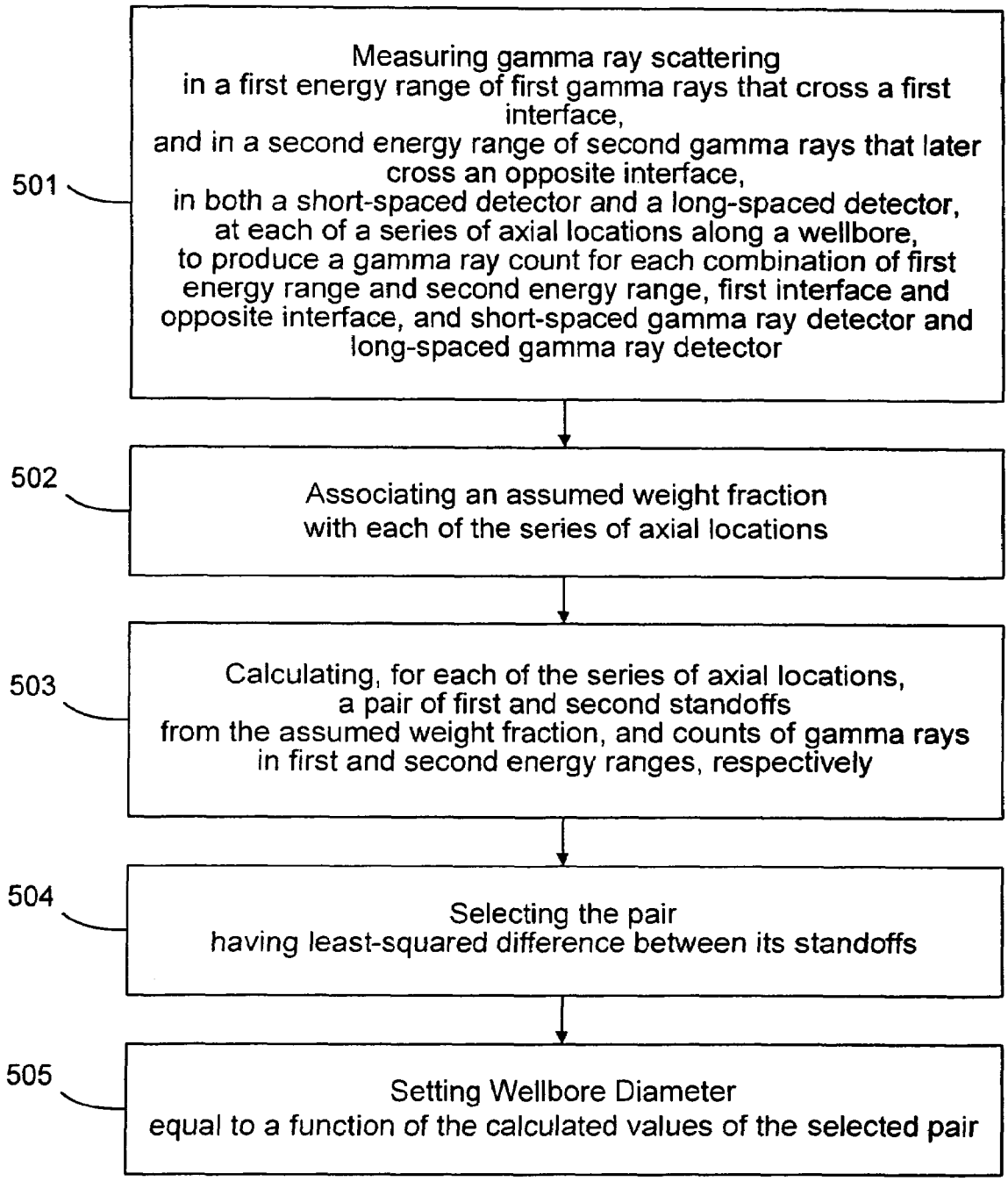
FIG. 5 is a flow chart illustrating a preferred embodiment of the method of the present invention.

The general flow of a first embodiment of the method of the invention is illustrated as steps 501-505 of FIG. 5. First, as shown by numeral 501, gamma ray scattering is measured in a first energy range of first gamma rays that cross a first interface, and in a second energy range of second gamma rays that later cross an opposite interface, in both a short-spaced detector and a long-spaced detector, at each of a series of axial locations along a wellbore to produce a gamma ray count for each combination of first energy range and second energy range, first interface and opposite interface, and short-spaced gamma ray detector and long-spaced gamma ray detector. Next, as shown by numeral 502, an assumed weight fraction is associated with each of the series of axial locations. Next, as shown by numeral 503, for each of the axial locations, one calculates a pair of first and second standoffs the assumed weight fraction and counts of gamma rays in first and second energy ranges, respectively. As shown by numerals 504 and 505, the pair having least-squared differenced between its standoffs is selected and the well bore diameter is set equal to a function of the calculated values of the selected pair.

Figure 6:
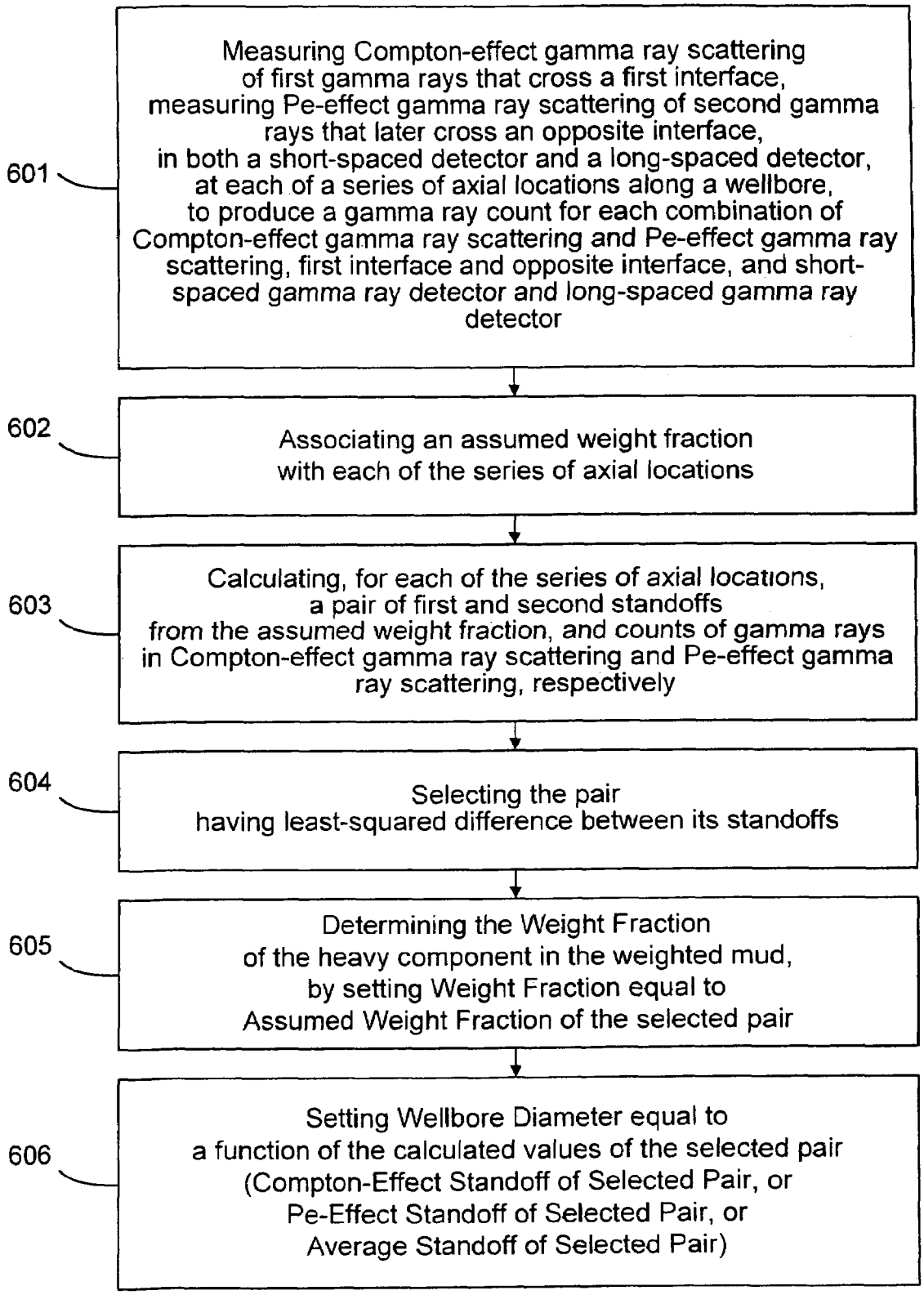
FIG. 6 is a flow chart showing additional detail of the method of FIG. 5.

A first preferred embodiment of the method is illustrated as steps 601-606 of FIG. 6. Steps 601-606 of FIG. 6 are discussed in detail, with reference to FIGS. 7-10, as follows.

Step 601: Measuring Gamma Ray Scattering to Produce Gamma Ray Counts

Figure 9:
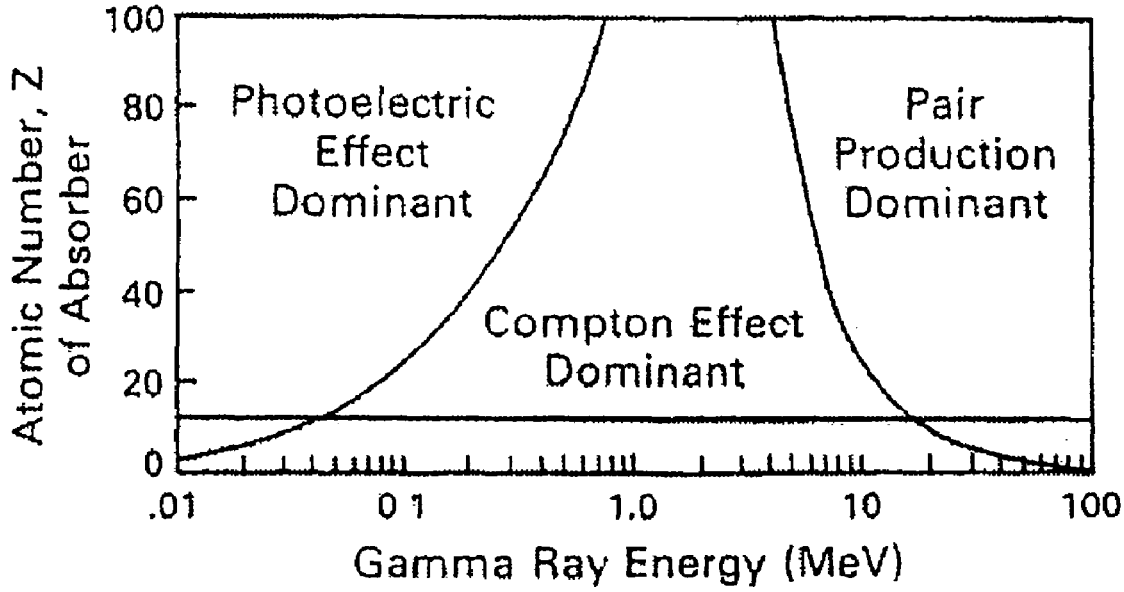
FIG. 9 is a graph showing three gamma ray energy ranges, two of which are utilized in the preferred embodiment of the invention.

FIG. 6 shows step 601 measuring Compton-effect gamma ray scattering and photoelectric-effect gamma ray scattering of gamma rays that cross a first interface, and of later gamma rays that cross an opposite interface, at each of a plurality of locations along a wellbore to produce gamma ray counts. The physics underlying step 601 is illustrated in FIG. 9. Details of step 601 are discussed below with reference to FIG. 7.

FIG. 9 is a graph showing three gamma-ray energy ranges, two of which are utilized in the method of FIG. 6. The three gamma ray energy ranges are defined by their dominant scattering mechanisms: photoelectric-effect dominant, Compton-effect dominant, and pair-production dominant. The first preferred embodiment uses a higher energy range wherein gamma ray scattering is dominated by Compton-effect, and a lower energy range wherein gamma ray scattering is dominated by photoelectric-effect. Other embodiments are contemplated using the highest energy range wherein gamma ray scattering is dominated by pair-production-effect. A second embodiment uses a higher energy range wherein gamma ray scattering is dominated by pair-production-effect, and a lower energy range wherein gamma ray scattering is dominated by Compton-effect. A third embodiment uses a higher energy range wherein gamma ray scattering is dominated by pair-production-effect, and a lower energy range wherein gamma ray scattering is dominated by photoelectric-effect. However, this third embodiment is likely to be of limited value because it is believed to be relatively insensitive to differences in weight fraction.

Figure 7:
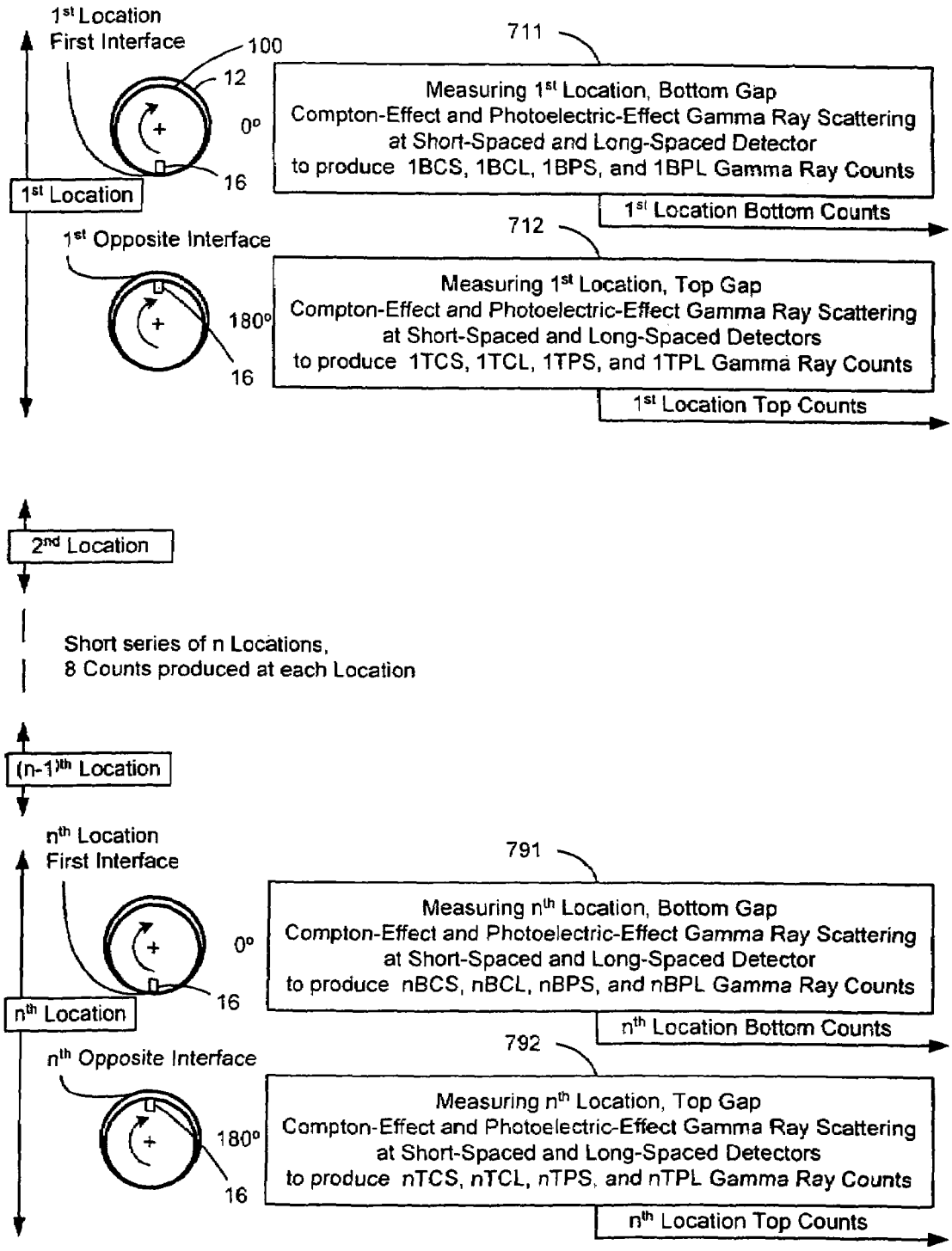
FIG. 7 is a flow chart showing additional detail of step 601 in FIG. 6.
Figure 8:
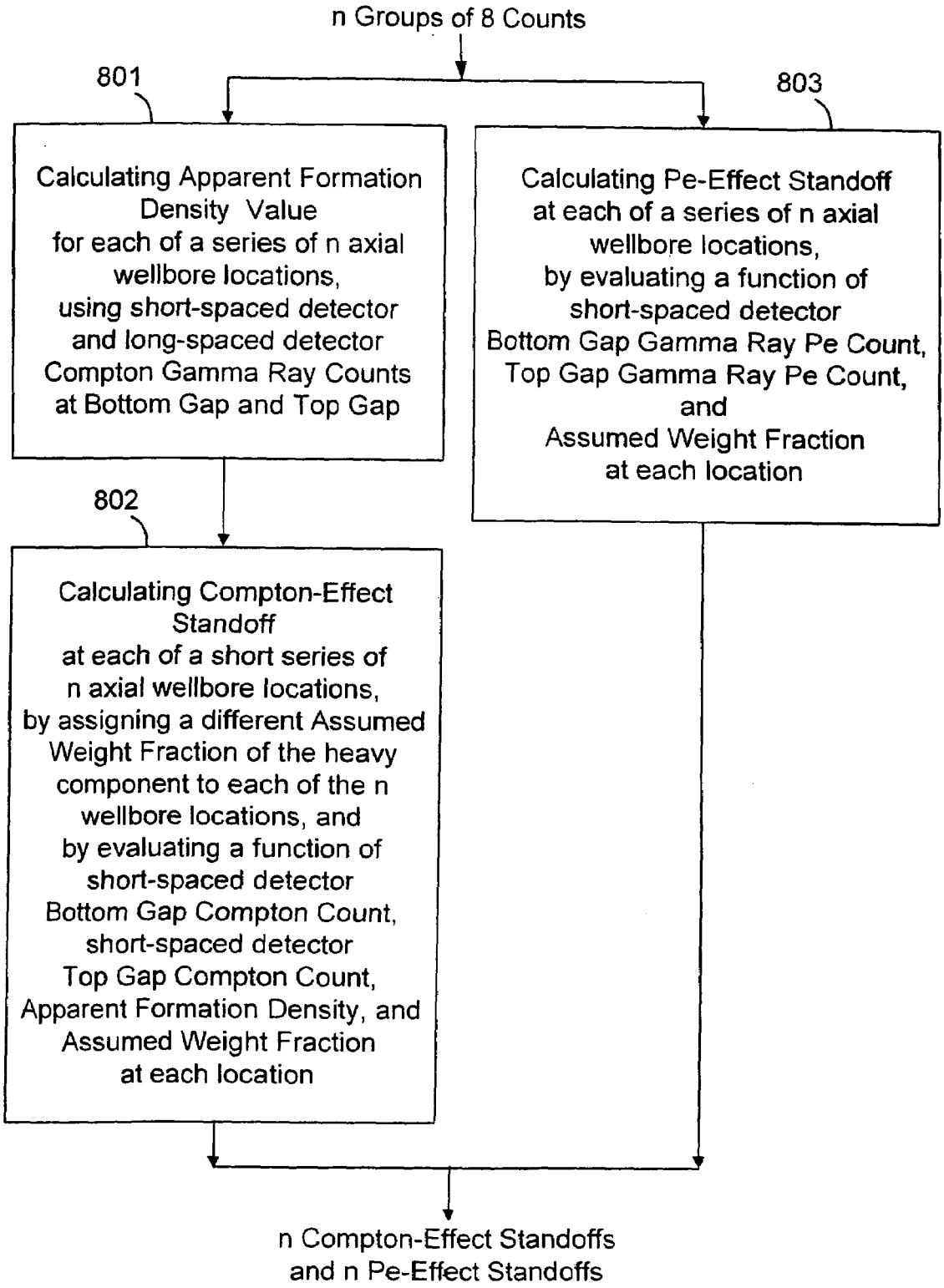
FIG. 8 is a flow chart showing additional detail of step 602 in FIG. 6.

FIG. 7 shows LWD instrument 100 rotating within wellbore 12. In a first location, at a 0° azimuthal orientation of LWD instrument 100, window 16 is at the bottom of the wellbore, defining a $1^{st}$ location, first (bottom) interface between the instrument and the wall of the wellbore. As indicated in step 711, measurements are made of Compton-effect gamma ray scattering at $1^{st}$ bottom gap (also shown in FIG. 4 as transient bottom interface 42) to produce $1^{st}$ location Compton bottom counts. These are 1BCS ($1^{st}$ location, Bottom gap, Compton-effect, Short-spaced) and 1BCL ($1^{st}$ location, Bottom gap, Compton-effect, Long-spaced) gamma ray counts. Simultaneously, measurements are made of photoelectric-effect gamma ray scattering at $1^{st}$ bottom gap to produce $1^{st}$ location Pe bottom counts. These are 1BPS ($1^{st}$ location, Bottom gap, Pe-effect, Short-spaced) and 1BPL ($1^{st}$ location, Bottom gap, Pe-effect, Long-spaced) gamma ray counts.

When the instrument has completed a half-turn at the same location, as shown in FIG. 7, window 16 is at 180° orientation, i.e. at the top of the wellbore, defining a $1^{st}$ opposite (top) interface between the instrument and the wall of the wellbore. As indicated in step 712, measurements are made of Compton-effect gamma ray scattering at $1^{st}$ top gap (not shown in FIG. 4) to produce $1^{st}$ location Compton top counts. These are 1TCS ($1^{st}$ location, Top gap, Compton-effect, Short-spaced) and 1TCL ($1^{st}$ location, Top gap, Compton-effect, Long-spaced) gamma ray counts. Simultaneously, measurements are made of photoelectric-effect gamma ray scattering at $1^{st}$ top gap to produce $1^{st}$ location Pe top counts. These are 1TPS ($1^{st}$ location, Top gap, Pe-effect, Short-spaced) and 1TPL ($1^{st}$ location, Top gap, Pe-effect, Long-spaced) gamma ray counts.

Thus four counts are made at the bottom gap and four counts are made half a turn later at the top gap in a single rotation of the instrument. This completes the group of eight counts made at the first location. FIG. 7 shows groups of four counts being made at each of a series of n locations and steps 711 and 712 are repeated as shown by 791 and 792. At each location the four bottom counts are made simultaneously, then half a turn later, the four top counts are made simultaneously. These data are transmitted to downhole computer 300 (see FIG. 3A) for processing through steps 602-606.

Step 602: Assigning Assumed Weight Fraction Values to Axial Locations

Step 602 associates an assumed weight fraction with each of the series of axial locations. The assumed value of weight fraction associated with each axial location monotonically increases over the series of axial locations, as indicated by the abscissa (progressing from left to right) in FIG. 10.

Step 603: Calculating Apparent Formation Density and Standoffs

FIG. 6 shows step 603 calculating an apparent formation density, a Compton-effect standoff, and a Pe-effect standoff at each of a series of wellbore locations, using gamma ray counts and a different (monotonically progressing) assumed weight fraction assigned to each of the wellbore locations. Each Compton-effect standoff is calculated from the pairs of bottom gap short-spaced detector and long-spaced detector Compton-effect gamma ray counts (e.g. 1BCS and 1BCL) in a two-step process. Compton-effect apparent standoff is calculated using linear-fit approximation to experimentally-derived density curves. Details of step 603 are discussed with reference to steps 801-803 in FIG. 8, as follows.

Each Compton-effect standoff is calculated in steps 801 and 802. Step 801 calculates apparent formation density value for each of the n wellbore locations using the Compton-effect gamma ray counts at bottom gap and top gap from each of the n groups. Step 801 uses the prior art process disclosed in U.S. Pat. No. 6,552,334 issued to Ellis et al.

Step 802 includes a first novel process (based on linear-fit approximation to experimentally-derived Pe curves) to calculate Compton-effect standoff at each of the n wellbore locations from the Compton-effect gamma ray counts at bottom gap and top gap for each of the n groups.

Before discussing the novel process of step 802, let us discuss in more detail FIG. 4 (prior art). FIG. 4 shows detail of the disposition of LWD instrument 100 rotating within wellbore 12. FIG. 4 is a cross section view of LWD instrument 100 through gamma ray detector window 109. (Section A-A in FIG. 2). LWD instrument 100 is shown in FIG. 4 rotating as indicated by arrow A within wellbore 12 of formation 32. Gamma ray detector 108 is shown behind a single gamma ray detector window 109 facing the bottom 41 of wellbore 12. (Wellbore 12 has an axis that is, for the purpose of illustration in FIGS. 1 and 4, substantially horizontal. Window 109, allowing transmission of gamma rays, is shown having an instantaneous azimuthal orientation of 0° while defining a transient bottom interface 42. At an azimuthal orientation of 0°, window 109 is typically very close to the lower, or downward, side of the wellbore (in a wellbore having inclination that is substantially horizontal), and the bottom gap, the distance between the instrument and the wall at the bottom of the wellbore, is close to zero. In contrast, the gaps, i.e. the standoffs 46, 47, and 48, at 135°, 180°, and 225° orientation respectively, may be substantial. Although these are the conventional quadrants, one skilled in the art would recognize that other quadrants may be selected.

With long-spaced detector window also at 0°, i.e. also very close to the wall at the bottom of the wellbore, the instrument is most likely to make a measurement that most closely corresponds to the density of the formation surrounding the wellbore. Preferably, the density measurement made with the instrument in this orientation is made using one of the "compensated" or "corrected" density measurement techniques known in the art, such as described in U.S. Pat. No. 3,321,625 issued to Wahl, or U.S. Pat. No. 5,530,243 issued to Mathis. A suitable method for determining when the source and detectors are oriented toward the bottom is described, for example, in U.S. Pat. No. 5,473,158 issued to Holenka et al. Other methods for determining the rotary orientation of instruments such as LWD instrument 100 are known in the art.

In the event the lower side of the wellbore includes irregularities in the wall thereof, such as "keyseats", or "washouts" or the like, a corrected, or compensated density measurement may be made at another rotary orientation of the instrument proximate to the 0° orientation, preferably at an orientation of less than 45° or greater than 315° (see FIG. 4), to ensure that the source and detectors are proximate the formation and are therefore arranged to make a suitably accurate corrected measurement of apparent formation density.

Returning now to FIG. 8, step 802 calculates Compton-effect standoff by evaluating a function of the local weight fraction B of the heavy component of drilling mud:

$$t_{so}(\rho_{mud}, B, c) = k\frac{\rho_b - \rho_{ls}}{\rho_b - (\rho_{mud} + c)} = k\frac{\rho_b - \rho_{ls}}{\rho_b - (\rho_{mud} + 1.7B + 0.034)} \quad (1)$$

where $t_{so}$ is the standoff (the total gap between instrument and wellbore at a given axial location, the sum of opposite gaps, e.g., bottom gap plus top gap), $\rho_{mud}$ is the actual mud density, B is the actual (unknown, local) weight fraction of BaSO4 in the mud, c is a constant associated with a linear-fit approximation to density curves drawn from experimental data, $\rho_b$ is the actual formation bulk density, and $\rho_{ls}$ is the apparent formation density as measured by the method of the long spacing detector.

Step 803 includes a second novel process (also based on linear-fit approximation to experimentally-derived Pe curves) for calculating standoff ("Pe-effect standoff") at each of the n wellbore locations from the Pe-effect gamma ray counts at bottom gap and top gap for each of the n groups. Step 803 calculates Pe-effect standoff by evaluating a function of the local weight fraction B of the heavy component of drilling mud:

$$t_{so}(Pe, B) = \frac{(Pe_{meas} - Pe_{form})}{(68.7B - 0.36)} = \frac{(Pe_{top} - Pe_{bottom})}{(68.7B - 0.36)} \quad (2)$$

where equation (2) is based on linear-fit approximation to experimentally-derived Pe curves, and where $t_{so}$ is the standoff (the total gap between instrument and wellbore at a given axial location, the sum of opposite gaps, e.g., bottom gap plus top gap), $Pe_{meas}$ is the apparent formation Pe, $Pe_{form}$ is the actual formation Pe, $Pe_{top}$ is the formation Pe measured at top gap, and $Pe_{bottom}$ is the formation Pe measured at bottom gap.

Step 604: Selecting the Pair of Standoffs

FIG. 6 shows step 604 selecting, from pairs of a Compton-effect standoff and a Pe-effect standoff along the wellbore having the same assumed weight fraction, the pair having least-squared difference between its standoffs.

The selection process of step 604 uses the least-squared difference selection function $$\sum_{i}^{1-n}(t_{so}(\rho_{mud}, B, c)_i - t_{so}(Pe, B)_i)^2. \quad (3)$$

Figure 10:
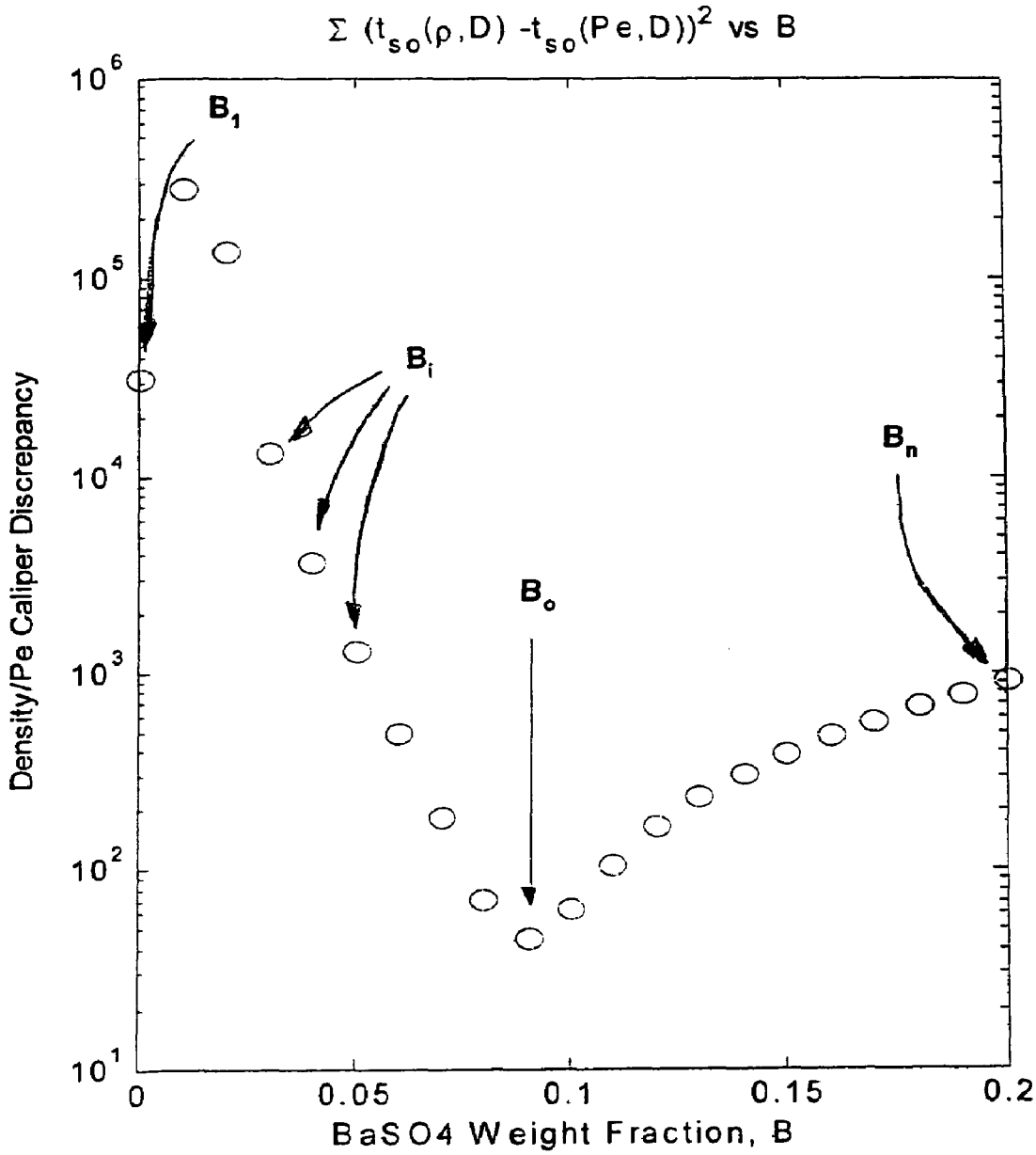
FIG. 10 is a graph further illustrating step 603 in FIG. 6.

FIG. 10 further illustrates the selection process of step 604. FIG. 10 is a graph showing density/Pe caliper discrepancy, calculated from experimental data at each of a series of assumed weight fractions Bi (B1-Bn) using equation (3). The selected pair is the pair associated with the minimum density/Pe caliper discrepancy in FIG. 10, i.e. the pair indicated in FIG. 10 by "Bo". Bo is the true local weight fraction.

Step 605: Determining Weight Fraction of Heavy Component

Step 605 in FIG. 6 includes a third novel process, a process for determining the weight fraction of the heavy component in the weighted mud. Weight fraction is set equal to assumed weight fraction of the selected pair. The assumed weight fraction of the selected pair is illustrated as "Bo" in FIG. 10.

Step 606: Determining Wellbore Diameter from Standoffs of the Selected Pair

Step 606 in FIG. 6 includes a fourth novel process, a process for determining wellbore diameter from the calculated values of the selected pair. Because the weight fraction associated with the selected pair must be the actual weight fraction, wellbore diameter is set equal to a function of the calculated standoffs of the selected pair. In a preferred embodiment, wellbore diameter is set equal to the calculated Pe-effect standoff of the selected pair. Since the calculated Pe-standoff of the selected pair is substantially equal to the calculated Compton-effect standoff of the selected pair, the wellbore diameter might equally be set equal to the calculated Compton-effect standoff, or to the average standoff of the selected pair.

Determining the Shape of a Wellbore

The method for determining the shape of a wellbore according to the present invention involves drilling the wellbore by a drill string immersed in weighted mud, the weighted mud having a weight fraction of a heavy component, the drill string including a well logging instrument, the instrument including a gamma ray source and an energy-sensitive gamma ray detector, the instrument rotating within the wellbore to define a transient interface with a facing portion of the wellbore wall. The method includes a) measuring first-mechanism gamma ray scattering and second-mechanism gamma ray scattering of gamma rays that cross a first interface, and of later gamma rays that cross an opposite interface, at each of a plurality of locations along a wellbore to produce gamma ray counts; b) calculating a first-mechanism standoff, and a second-mechanism standoff, at each of a series of wellbore locations, from weight fraction and gamma ray counts; c) selecting, from pairs of a first-mechanism standoff and a second-mechanism standoff along the wellbore having the same assumed weight fraction, the pair having least-squared difference between its standoffs; and d) setting wellbore diameter equal to a standoff of the selected pair.

Determining the Longitudinal Shape of the Wellbore

The "series of axial locations along a wellbore" mentioned above, over which steps a) to d) are applied to determine the diameter of a wellbore at a given location, represents a comparatively short distance compared to the entire length of the wellbore. Accordingly, determining the longitudinal shape of the wellbore by determining the diameter of the wellbore at multiple locations along the wellbore, includes applying steps a) to d) at multiple "series of axial locations along the wellbore".

Determining the Circumferential Shape of the Wellbore

In various embodiments of the invention, a plurality of standoff measurements at different azimuthal locations may be made at selected axial instrument positions along the wellbore. The individual standoff measurements may be made to correspond to the instrument azimuthal orientation at the time each measurement is made. The azimuthal orientation of the instrument may be determined at any time by methods known in the art, including one described in the Holenka et al. '158 patent. The standoff measurements may then be combined with the diameter of the instrument to determine an approximate shape of the wall of the wellbore at any or all of the axial positions at which the standoff measurements are made. Methods for determining wellbore shape from standoff measurements made at a plurality of rotary orientations are known in the art. See, for example, U.S. Pat. No. 5,513,528 issued to Holenka et al.

An image of the wellbore diameter may be made using various embodiments of the invention by moving the logging instrument along the wellbore axially, while rotating the logging instrument. Measurements of standoff, and wellbore diameter corresponding thereto may be made at various azimuthal orientations of the instrument at each axial position of the instrument. As the instrument is moved along the wellbore axially, the standoff/diameter measurements of the wellbore at various azimuthal orientations may be repeated. By repeating the standoff/diameter measurements at various rotary orientations at a plurality of axial positions of the instrument along the wellbore, an "image" of the wellbore related to the wellbore diameter may be developed. Methods for generating various images from azimuthally and axially spaced apart wellbore measurements are well known in the art.

It should be noted that the previously described embodiment of a method according to this invention is intended to be used with a well logging instrument having one set of axially aligned detectors and a gamma ray source. The invention is not, however, limited to use with such instruments. Another type of LWD apparatus may be used that includes a plurality of source/detector arrangements, each of which arrangement is positioned at a unique position about the circumference of the instrument. Such an instrument would make a similar set of measurements, as does the instrument described previously herein, at selected axial positions along the wellbore. Such measurements may be processed according to the method of the invention to derive a standoff measurement corresponding to the azimuthal position of each one of the source/detector arrangements.

It should also be noted that the disclosed techniques do not depend on whether the source and detectors in any density logging instrument used therefor are disposed in an upset portion, such as a stabilizer or the like, or are disposed in a "slick" portion (smooth exterior surface having substantially constant external diameter) of a drill collar. It is only necessary, to determine the approximate shape of the wellbore, to know the external diameter of the instrument at the position of the source and detectors to be able to determine standoff and wellbore shape.

What is claimed is:

1. A method for determining the diameter of a wellbore while the wellbore is being drilled by a drill string immersed in weighted mud, the weighted mud having a weight fraction of a heavy component, the drill string including a well logging instrument, the instrument rotating to define a transient interface with a facing portion of the wellbore wall, the instrument including a gamma ray source, an energy-sensitive short-spaced gamma ray detector, and an energy-sensitive long-spaced gamma ray detector, the method comprising:

a) measuring gamma ray scattering in a first energy range of first gamma rays that cross a first interface, and in a second energy range of second gamma rays that later cross an opposite interface, in both a short-spaced detector and a long-spaced detector, at each of a series of axial locations along a wellbore, to produce a gamma ray count for each combination of first energy range and second energy range, first interface and opposite interface, and short-spaced gamma ray detector and long-spaced gamma ray detector;

b) associating an assumed weight fraction with each of the series of axial locations;

c) calculating, for each of the series of axial locations, a pair of first and second standoffs from the assumed weight fraction, and counts of gamma rays in first and second energy ranges, respectively;

d) selecting the pair having least-squared difference between its standoffs; and e) determining wellbore diameter by setting wellbore diameter equal to a function of the calculated values of the selected pair.

2. A method according to claim 1, wherein gamma ray scattering in a first energy range is Compton-effect gamma ray scattering, gamma ray scattering in a second energy range is photoelectric-effect gamma ray scattering, first standoff is Compton-effect standoff, and second standoff is Pe-effect standoff.

3. A method according to claim 2, wherein calculating a Compton-effect standoff for a given location includes using Compton counts to determine formation density at the given location.

4. A method according to claim 3, wherein calculating a Compton-effect standoff includes evaluating a function of assumed weight fraction and formation density.

5. A method according to claim 2, wherein calculating a photoelectric-effect standoff includes evaluating a function of assumed weight fraction and Pe counts.

6. A method according to claim 5, wherein the function of assumed weight fraction and Pe counts is based on linear-fit approximation to experimentally-derived Pe curves.

7. A method according to claim 1, wherein measuring scattering of gamma rays at a given location includes registering counts from gamma rays traveling across a first interface, and, after a half-turn of the instrument within the wellbore, registering counts from later gamma rays traveling across an opposite interface.

8. A method according to claim 7, wherein the first interface is a bottom interface, and the opposite interface is a top interface.

9. A method according to claim 1, further comprising determining weight fraction by setting weight fraction equal to the assumed weight fraction of the selected pair.

10. A method according to claim 1, wherein the assumed value of weight fraction associated with each axial location is monotonically increasing over the series of axial locations.

11. A method according to claim 1, wherein gamma ray scattering in a first energy range is pair-production-effect gamma ray scattering, gamma ray scattering in a second energy range is Compton-effect gamma ray scattering, first standoff is pair-production-effect standoff, and second standoff is Compton-effect standoff.

12. A method according to claim 1, wherein gamma ray scattering in a first energy range is pair-production-effect gamma ray scattering, gamma ray scattering in a second energy range is photoelectric-effect gamma ray scattering, first standoff is pair-production-effect standoff, and second standoff is photoelectric-effect standoff.

13. A method for determining the longitudinal shape of a wellbore while the wellbore is being drilled by a drill string immersed in weighted mud, the weighted mud having a weight fraction of a heavy component, the drill string including a well logging instrument, the instrument rotating to define a transient interface with a facing portion of the wellbore wall, the instrument including a gamma ray source, an energy-sensitive short-spaced gamma ray detector, and an energy-sensitive long-spaced gamma ray detector, the method comprising:

a) measuring gamma ray scattering in a first energy range of first gamma rays that cross a first interface, and in a second energy range of second gamma rays that later cross an opposite interface, in both a short-spaced detector and a long-spaced detector, at each of a series of axial locations along a wellbore, to produce a gamma ray count for each combination of first energy range and second energy range, first interface and opposite interface, and short-spaced gamma ray detector and long-spaced gamma ray detector;

b) associating an assumed weight fraction with each of the series of axial locations;

c) calculating, for each of the series of axial locations, a pair of first and second standoffs from the assumed weight fraction, and counts of gamma rays in first and second energy ranges, respectively;

d) selecting the pair having least-squared difference between its standoffs;

e) determining wellbore diameter by setting wellbore diameter equal to a function of the calculated values of the selected pair; and f) repeating steps a) to e) at each of a plurality of series of axial locations along the wellbore to determine wellbore diameter at axial regions corresponding to each of the plurality of series of axial locations.

14. A method for determining the circumferential shape of a wellbore while the wellbore is being drilled by a drill string immersed in weighted mud, the weighted mud having a weight fraction of a heavy component, the drill string including a well logging instrument, the instrument rotating to define a transient interface with a facing portion of the wellbore wall, the instrument including a gamma ray source, an energy-sensitive short-spaced gamma ray detector, and an energy-sensitive long-spaced gamma ray detector, the method comprising:

a) determining weight fraction of the weighted mud in the region of a series of axial locations along a wellbore;

b) measuring gamma ray scattering in a first energy range of first gamma rays that cross a first interface, and in a second energy range of second gamma rays that later cross an opposite interface, in both a short-spaced detector and a long-spaced detector, in the region of the series of axial locations along a wellbore, to produce a gamma ray count for each combination of first energy range and second energy range, first interface and opposite interface, and short-spaced gamma ray detector and long-spaced gamma ray detector;

c) calculating standoff from the weight fraction and counts of gamma rays;

d) repeating steps b) to c) at a series of azimuthal locations around the wellbore to produce a series of to standoffs at the series of azimuthal locations; and e) determining the circumferential shape of the wellbore by setting wellbore diameter at each azimuthal locations equal to its corresponding standoff.

* * * * *